US007482772B2

(12) United States Patent
Nireki et al.

(10) Patent No.: US 7,482,772 B2
(45) Date of Patent: Jan. 27, 2009

(54) MOTOR STOP CONTROL DEVICE UTILIZABLE FOR GAMING MACHINE AND GAMING MACHINE USING THE SAME

(75) Inventors: Takao Nireki, Tokyo (JP); Yuuichirou Suzuki, Tokyo (JP)

(73) Assignee: Aruze Corp., Tokyo (JP)

( * ) Notice: Subject to any disclaimer, the term of this patent is extended or adjusted under 35 U.S.C. 154(b) by 657 days.

(21) Appl. No.: 10/954,154

(22) Filed: Sep. 30, 2004

(65) Prior Publication Data

US 2005/0096122 A1 May 5, 2005

(30) Foreign Application Priority Data

Oct. 2, 2003 (JP) ..... 2003-344400

(51) Int. Cl.
*A63F 9/24* (2006.01)

(52) U.S. Cl. ..... 318/368; 318/696; 463/20; 273/143 R

(58) Field of Classification Search ..... 318/368, 318/685, 696; 463/16, 17, 20; 273/138.1, 273/142 R, 143 R, 148 R
See application file for complete search history.

(56) References Cited

U.S. PATENT DOCUMENTS 4,564,796 A * 1/1986 Yoshino et al. ..... 318/696
4,573,681 A 3/1986 Okada
4,697,129 A 9/1987 Enami et al.
4,916,370 A * 4/1990 Rowan et al. ..... 318/368
4,978,897 A * 12/1990 Merrison et al. ..... 318/268
5,231,342 A * 7/1993 Bahn ..... 318/696
5,250,883 A * 10/1993 Okada ..... 318/494
5,451,832 A * 9/1995 Cameron et al. ..... 318/375
5,609,524 A 3/1997 Inoue
5,619,109 A * 4/1997 Cameron et al. ..... 318/375
5,839,957 A * 11/1998 Schneider et al. ..... 463/20
5,988,638 A * 11/1999 Rodesch et al. ..... 273/143 R
6,003,867 A * 12/1999 Rodesch et al. ..... 273/143 R
6,547,663 B1 * 4/2003 Delott et al. ..... 463/25
6,998,805 B2 * 2/2006 Nireki et al. ..... 318/362
2003/0085621 A1 * 5/2003 Potega ..... 307/18
2004/0018869 A1 * 1/2004 Inoue ..... 463/20

FOREIGN PATENT DOCUMENTS

EP 0 414 428 A 2/1991
EP 0 415 706 A 3/1991
EP 0 875 870 A 11/1998
JP 10-071240 3/1998

* cited by examiner

*Primary Examiner*—Bentsu Ro
(74) *Attorney, Agent, or Firm*—Arent Fox LLP

(57) ABSTRACT

In the motor stop control device according to the embodiment, a main CPU is provided which executes any one of reel stop control process 1 and the reel stop control process 2 when the stop instruction of a stepping motor occurs. In the reel stop control process 1, the main CPU changes a drive power source A, which is applied to the stepping motor rotating at the constant speed, to the drive power source B2, the voltage value of which is lower that that of the drive power source A, and executes the stop control of the stepping motor by the 2-phase excitation. In the reel stop control process 2, the main CPU changes the drive power source A, which is applied to the stepping motor rotating at the constant speed, to the drive power source B1,the voltage value of which is between the voltage values of the drive power source A and the drive power source B2, and executes the stop control of the stepping motor by the 2-phase excitation.

4 Claims, 13 Drawing Sheets

FIG.5

≪REEL STOP CONTROL PROCESS≫

| | DRIVE POWER SOURCE UTILIZED WHEN REEL STOP | EXCITATION PROCESS |
|---|---|---|
| REEL STOP CONTROL 1 | POWER SOURCE B2 | 2-PHASES ON |
| REEL STOP CONTROL 2 | POWER SOURCE B1 | 2-PHASES ON |

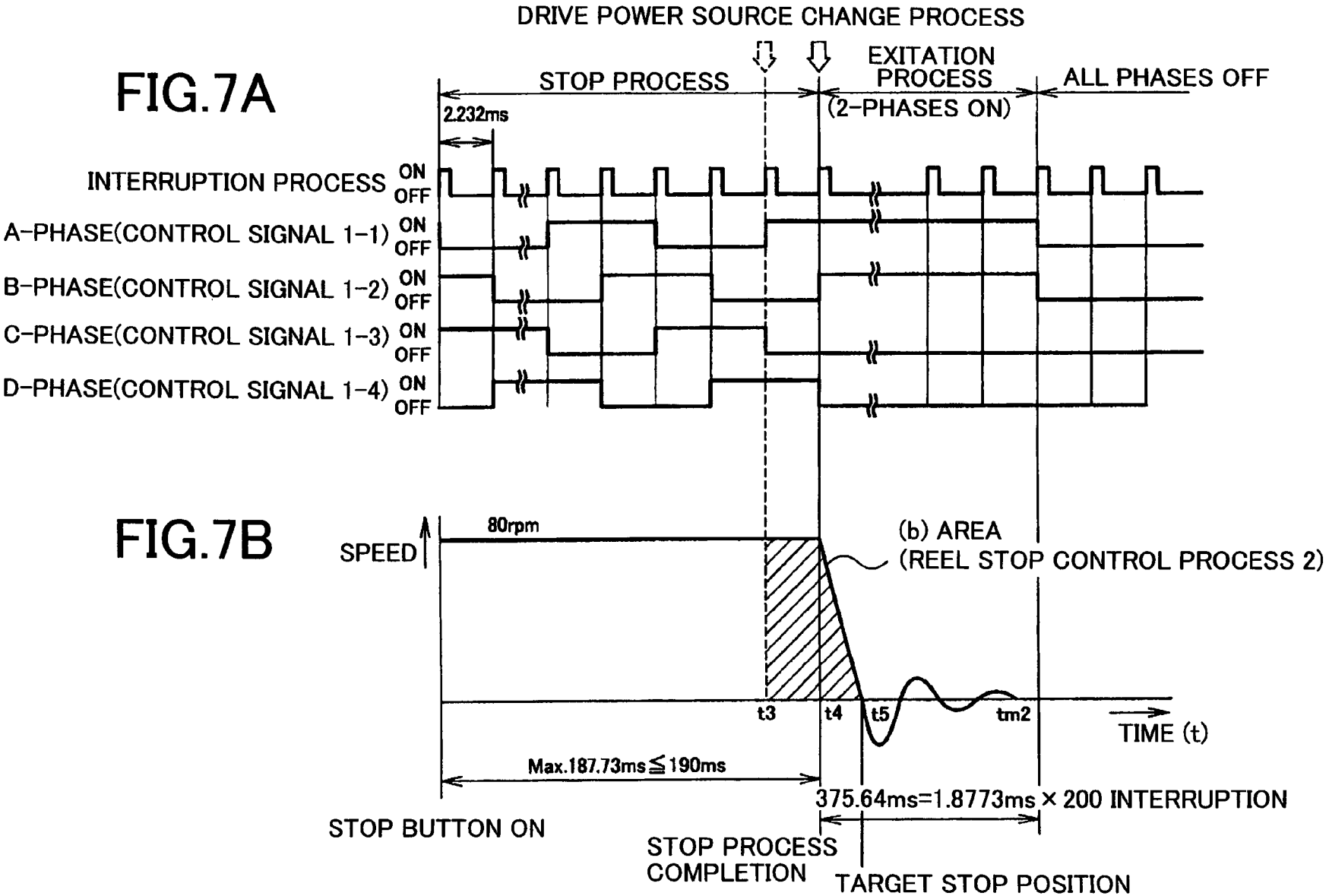
DRIVE POWER SOURCE CHANGE PROCESS
STOP PROCESS
EXITATION PROCESS
(2-PHASES ON)
ALL PHASES OFF
2.232ms
INTERRUPTION PROCESS
ON
OFF
A-PHASE(CONTROL SIGNAL 1-1)
B-PHASE(CONTROL SIGNAL 1-2)
C-PHASE(CONTROL SIGNAL 1-3)
D-PHASE(CONTROL SIGNAL 1-4)
FIG.7A
SPEED
80rpm
(b) AREA
(REEL STOP CONTROL PROCESS 2)
t3
t4
t5
tm2
TIME (t)
Max.187.73ms≦190ms
375.64ms=1.8773ms × 200 INTERRUPTION
STOP BUTTON ON
STOP PROCESS COMPLETION
TARGET STOP POSITION
FIG.7B

FIG.9

| | CONTROL SIGNAL 1 | CONTROL SIGNAL 2 | POWER SOURCE |
|---|---|---|---|
| POTATION AT CONSTANT SPEED | ON | OFF | A |
| EXCITATION PROCESS IN REEL STOP CONTROL PROCESS 1 | OFF | OFF | B2 |
| EXCITATION PROCESS IN REEL STOP CONTROL PROCESS 2 | OFF | ON | B1 |

FIG.10

《 SELECTION TABLE 》

| WINNING COMBINATION | REEL STOP CONTROL PROCESS |
|---|---|
| WATER MELON | REEL STOP CONTROL PROCESS 1 |
| BELL | REEL STOP CONTROL PROCESS 1 |
| CORNER CHERRY | REEL STOP CONTROL PROCESS 1 |
| CENTER CHERRY | REEL STOP CONTROL PROCESS 1 |
| REPLAY | REEL STOP CONTROL PROCESS 1 |
| RB | REEL STOP CONTROL PROCESS 2 |
| BB | REEL STOP CONTROL PROCESS 2 |
| LOSS OF WINNING COMBINATION | REEL STOP CONTROL PROCESS 1 |

MOTOR STOP CONTROL DEVICE UTILIZABLE FOR GAMING MACHINE AND GAMING MACHINE USING THE SAME

CROSS-REFERENCE TO THE RELATED APPLICATION (S)

This application is based upon and claims a priority from the prior Japanese Patent Application No. 2003-324446 filed on Sep. 17, 2003, the entire contents of which are incorporated herein by reference. This application is related to co-pending U.S. applications entitled "MOTOR STOP CONTROL DEVICE UTILIZABLE FOR REEL-TYPE GAMING MACHINE" filed on Apr. 29, 2004 and "MOTOR DRIVE CONTROL DEVICE UTILIZABLE FOR REEL-TYPE GAMING MACHINE" filed on Sep. 9, 2004, "MOTOR STOP CONTROL DEVICE FOR GAMING MACHINE AND GAMING MACHINE PROVIDED WITH THE MOTOR STOP CONTROL DEVICE", filed on Jul. 30, 2004 and "MOTOR STOP CONTROL DEVICE UTILIZABLE FOR GAMING MACHINE AND GAMING MACHINE USING THE SAME" filed on Sep. 15, 2004. The co-pending applications are expressly incorporated herein by reference.

BACKGROUND OF THE INVENTION

1. Field of the Invention

The present invention relates to a motor stop control device utilized in a reel-type gaming machine and a gaming machine using the motor stop control device, the motor stop control device having a motor as a drive source of a reel on which a plurality of symbols are formed and stopping the motor corresponding to a stop instruction from an external.

2. Description of Related Art

Conventionally, in a motor stop control device for a reel-type gaming machine (for example, a Japanese Pachi-slot machine), a reel is directly connected to a rotor of a stepping motor (abbreviated as "direct drive manner") as shown in Japanese Unexamined Publication No. 10-71240. In the motor stop control device utilizing the direct drive manner, all phases of the stepping motor are excited and a detent torque occurs in the stepping motor, thereby smooth stop of the reel is realized.

However, since stop control of the stepping motor is conducted only by all phase excitation in the above motor stop control device, it cannot be done in the gaming machine an effect to inform internal winning combinations or that the internal winning combinations are carried over by changing a stop process of the reels.

Therefore, it is desired that a motor stop control device capable of making the reel stop mode variegated is developed.

SUMMARY OF THE INVENTION

The present invention has been done and has an object to provide a motor stop control device capable of making a reel stop mode variegated and a gaming machine having such motor stop control device.

In order to accomplish the above object, according to one aspect of the present invention, it is provided a motor stop control device utilizable for a gaming machine with a reel on which a plurality of symbols are formed, the motor stop control device comprising:

a winning combination determination device for determining a winning combination;

a motor with a plurality of excitation phases to rotate the reel; and a motor stop controller for stopping the motor based on a stop instruction;

wherein the motor stop controller executes any one of a first process and a second process corresponding to the winning combination determined by the winning combination determination device when the stop instruction occurs, in the first process the motor stop controller decreasing a predetermined voltage value applied to the motor rotating at a constant speed to a first voltage value lower than the predetermined voltage value and executing a stop control of the motor by the 2-phase excitation and in the second process the motor stop controller decreasing the predetermined voltage value to a second voltage value which lies between the predetermined voltage value and the first voltage value and executing the stop control by the 2-phase excitation.

In the above motor stop control device, the motor stop controller executes any one of a first process and a second process corresponding to the winning combination determined by the winning combination determination device when the stop instruction occurs. Here, in the first process the motor stop controller decreases a predetermined voltage value applied to the motor rotating at a constant speed to a first voltage value lower than the predetermined voltage value and executes a stop control of the motor by the 2-phase excitation. And in the second process the motor stop controller decreases the predetermined voltage value to a second voltage value which lies between the predetermined voltage value and the first voltage value and executes the stop control by the 2-phase excitation.

According to the above motor stop control device, based on that the motor stop controller executes any one of the first process and the second process corresponding to a kind of the winning combination, stop mode of the reel can be variegated and interest for games can be raised. Further, since the stop mode is changed according to the kind of the winning combination, the kind of the winning combination can be informed to a player by variously changing the stop mode of the reel through the motor stop control device.

Further, according to another aspect of the present invention, it is provided a gaming machine comprising:

a reel on which a plurality of symbols are formed;

a motor stop control device having a motor with a plurality of excitation phases to rotate the reel and a motor stop controller for stopping the motor based on a stop instruction;

a winning combination determination device for determining a winning combination;

wherein the motor stop controller executes any one of a first process and a second process corresponding to the winning combination determined by the winning combination determination device when the stop instruction occurs, in the first process the motor stop controller decreasing a predetermined voltage value applied to the motor rotating at a constant speed to a first voltage value lower than the predetermined voltage value and executing a stop control of the motor by 2-phase excitation and in the second process the motor stop controller decreasing the predetermined voltage value to a second voltage value which lies between the predetermined voltage value and the first voltage value and executing the stop control by the 2-phase excitation.

In the above motor stop control device of the above gaming machine, the motor stop controller executes any one of a first process and a second process corresponding to the winning combination determined by the winning combination determination device when the stop instruction occurs. Here, in the first process the motor stop controller decreases a predetermined voltage value applied to the motor rotating at a constant speed to a first voltage value lower than the predetermined voltage value and executes a stop control of the motor by the 2-phase excitation. And in the second process the motor stop controller decreases the predetermined voltage value to a second voltage value which lies between the predetermined voltage value and the first voltage value and executes the stop control by the 2-phase excitation.

According to the above motor stop control device, based on that the motor stop controller executes any one of the first process and the second process corresponding to a kind of the winning combination, stop mode of the reel can be variegated and interest for games can be raised. Further, since the stop mode is changed according to the kind of the winning combination, the kind of the winning combination can be informed to a player by variously changing the stop mode of the reel through the motor stop control device.

As mentioned, according to the present invention, the stop mode of the reel can be variegated, therefore interest for games can be raised.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

In the drawings,

FIG. 3 is an explanatory view showing the reel and a lamp case.

FIG. 5 is an explanatory view to explain a reel stop control process done in the embodiment, FIG. 6 is a timing chart to explain the reel stop control process 1 done in the embodiment, FIG. 7 is a timing chart to explain the reel stop control process 1 done in the embodiment, FIG. 7A is an explanatory view indicating pulses in each phase, the pulses being transmitted from a main CPU to a motor drive circuit during a stop process and an excitation process and FIG. 7B is an explanatory view indicating a rotation speed of the reel against time when the motor drive circuit drives the stepping motor, FIG. 9 is an explanatory view showing power sources utilized in the reel stop control processes conducted in the embodiment, FIG. 10 is an explanatory view showing a selection table in which winning combinations and the reel stop control processes are corresponded with each other.

DETAILED DESCRIPTION OF THE PREFERRED EMBODIMENTS (Basic Construction of Motor Drive Control Device)

Figure 1:
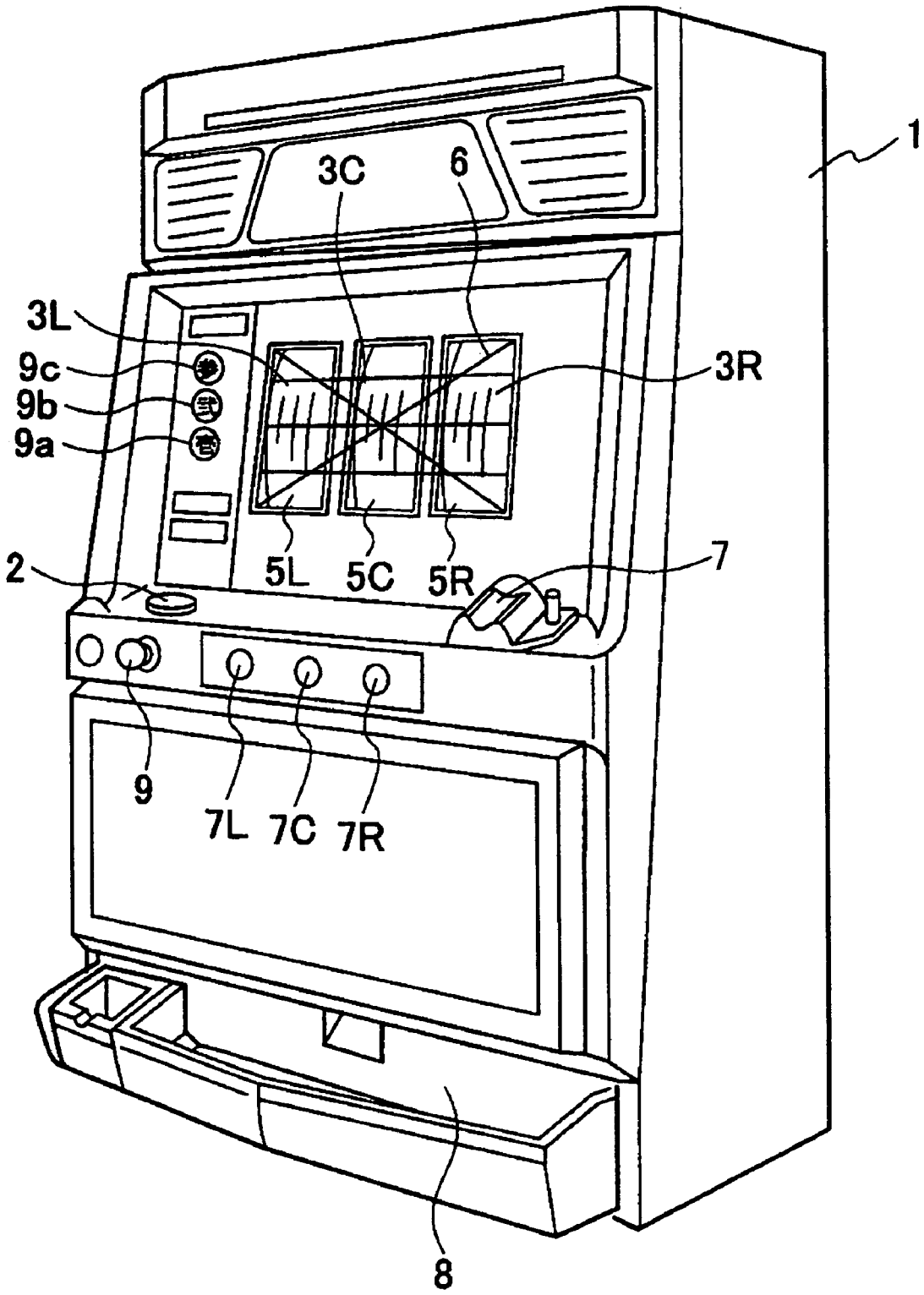
FIG. 1 is a perspective view of a gaming machine according to the embodiment.

The motor drive control device of the embodiment will be described with reference to the drawings. FIG. 1 is a perspective view of a reel-type gaming machine according to the embodiment.

As shown in FIG. 1, in front of a cabinet forming a whole construction of the reel-type gaming machine 1, three panel display windows 5L, 5C, 5R are formed. Reels 3L, 3C, 3R constructing a reel unit are seen and recognized through the panel display windows 5L, 5C, 5R, respectively. And on the panel display windows 5L, 5C, 5R, three pay lines 6 are described along three horizontal directions and two pay lines 6 are described along two oblique directions. These pay lines 6 are made effective according to the number of coins inserted through an insertion slot 4 and the number of pay lines 6 are determined.

Each of the reels 3L, 3C, 3R starts to rotate when a player inserts coins in the insertion slot 4 and operates a start lever 9. And when the player presses stop buttons 7L, 7C, 7R arranged corresponding to the reels 3L, 3C, 3R respectively, rotation of the reels 3L, 3C, 3R is stopped. Further, based on a symbol combination of each of reels 3L, 3C, 3R which are seen and recognized through each of the panel display windows 5L, 5C, 5R when rotation of the reels 3L, 3C, 3R is stopped, a winning mode is determined. And when winning is obtained, coins the number of which corresponds to the winning mode are paid out to a coin tray 8.

Hereinafter, for convenience sake of explanation, although description will be done to limit to the left panel display window 5L (merely abbreviated as "the panel display window 5" hereinafter), the left reel 3L (merely abbreviated as "the reel 3" hereinafter), the left support plate 80L (merely abbreviated as "the support plate 80 hereinafter), the left stepping motor 49L (merely abbreviated as "the stepping motor 49 hereinafter), among three panel display windows 5L, 5C, 5R, three reels 3L, 3C, 3R, three support plates 80L, 80C, 80R, three stepping motors 49L, 49C, 49R, the other panel display windows 5C, 5R, the other reels 3C, 3R, the other support plates 80C, 80R, the other stepping motors 49C, 49R have the same construction as those of the panel display window 5L, the reel 3L, the support plate 80L, the stepping motor 49L, so long as explanation is not especially referred.

Figure 2:
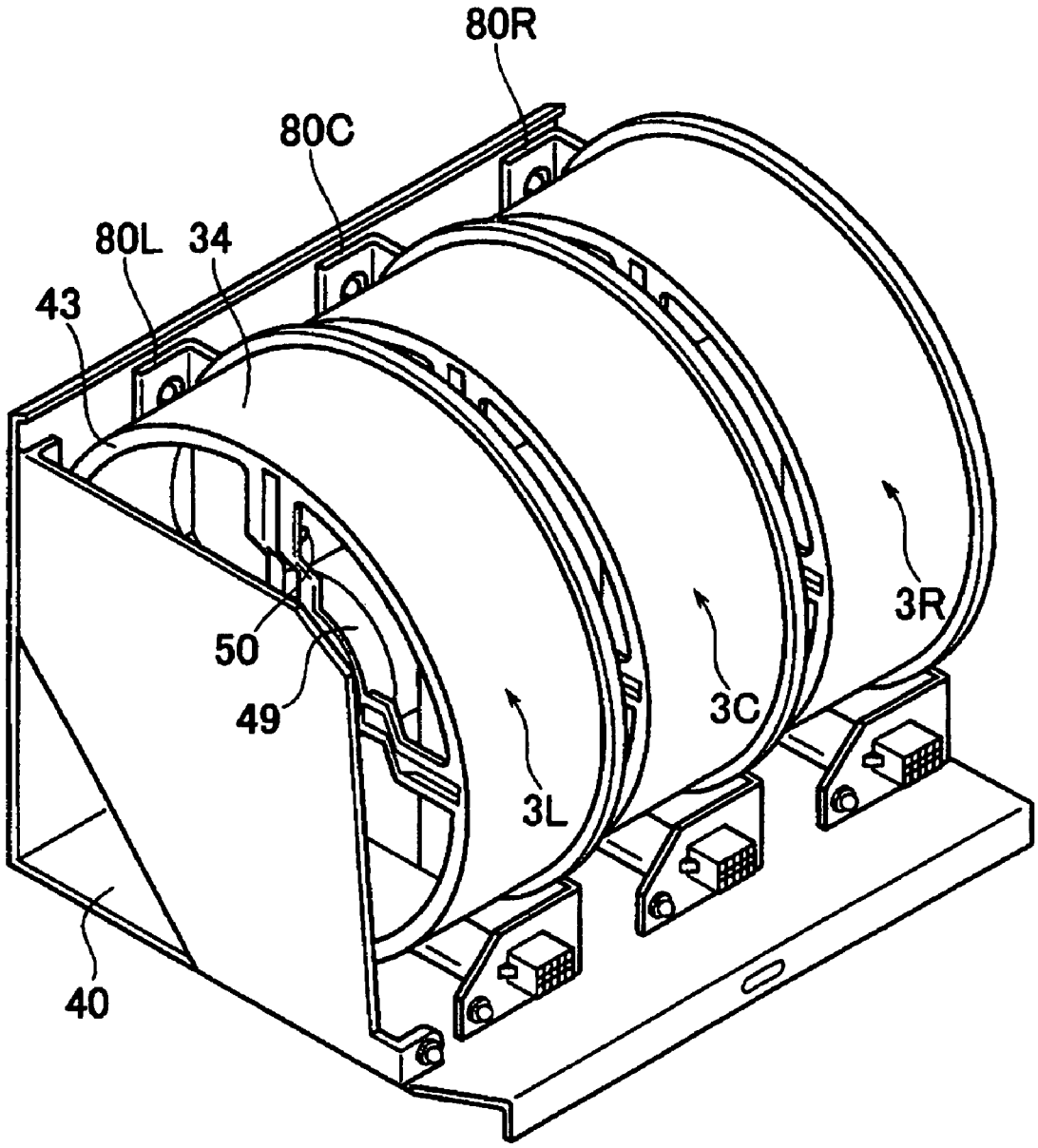
FIG. 2 is a perspective view showing a construction of reels when obliquely seeing the reels in the embodiment.

FIG. 2 is a perspective view showing the construction of the reel unit arranged within the panel display windows 5L, 5C, 5R. As shown in FIG. 2, the reel 3 is supported to the frame 40 through the support plate 80. In the reel 3, on an outer periphery of the reel drum 43, a reel strip 34 is adhered. And on an outer surface of the reel strip 34, a plurality of symbols are described.

To the support plate 80, the stepping motor 49 is arranged and the reel 3 is rotated based on that the stepping motor 49 is driven. A drive shaft of the stepping motor 49 according to the embodiment is directly pressed in a center hole of the reel 3 (direct drive manner).

FIG. 3 is an explanatory view showing a construction of the reel 3. As shown in FIG. 3, in the reel drum 43 positioned behind the reel strip 34, a lamp case 51 is arranged. And in each of three parts formed in the lamp case 51, a back lamp 52*a* is arranged. The back lamp 52*a* is constructed from a full-color LED (Light-emitting diode) capable of emitting large light quantity, and is assembled on a circuit board 53. This circuit board 53 is arranged behind the lamp case 51.

A photosensor 54 is arranged on the support plate 80. The photosensor 54 detects that a sensor plate 50 formed in the reel drum 43 passes the photosensor 54 according to rotation of the reel drum 43.

Each of the back lamps 52*a* is controlled so as to turn on and off by a lamp drive circuit 45. Based on that each of the back lamps 52*a* is turned on, three symbols, which are positioned in front of the back lamps 52*a*, among plural symbols described on the reel strip 34, are independently illuminated from the behind thereof. Thereby, three symbols are projected on each of the panel display windows 5L, 5C, 5R.

Figure 3A:
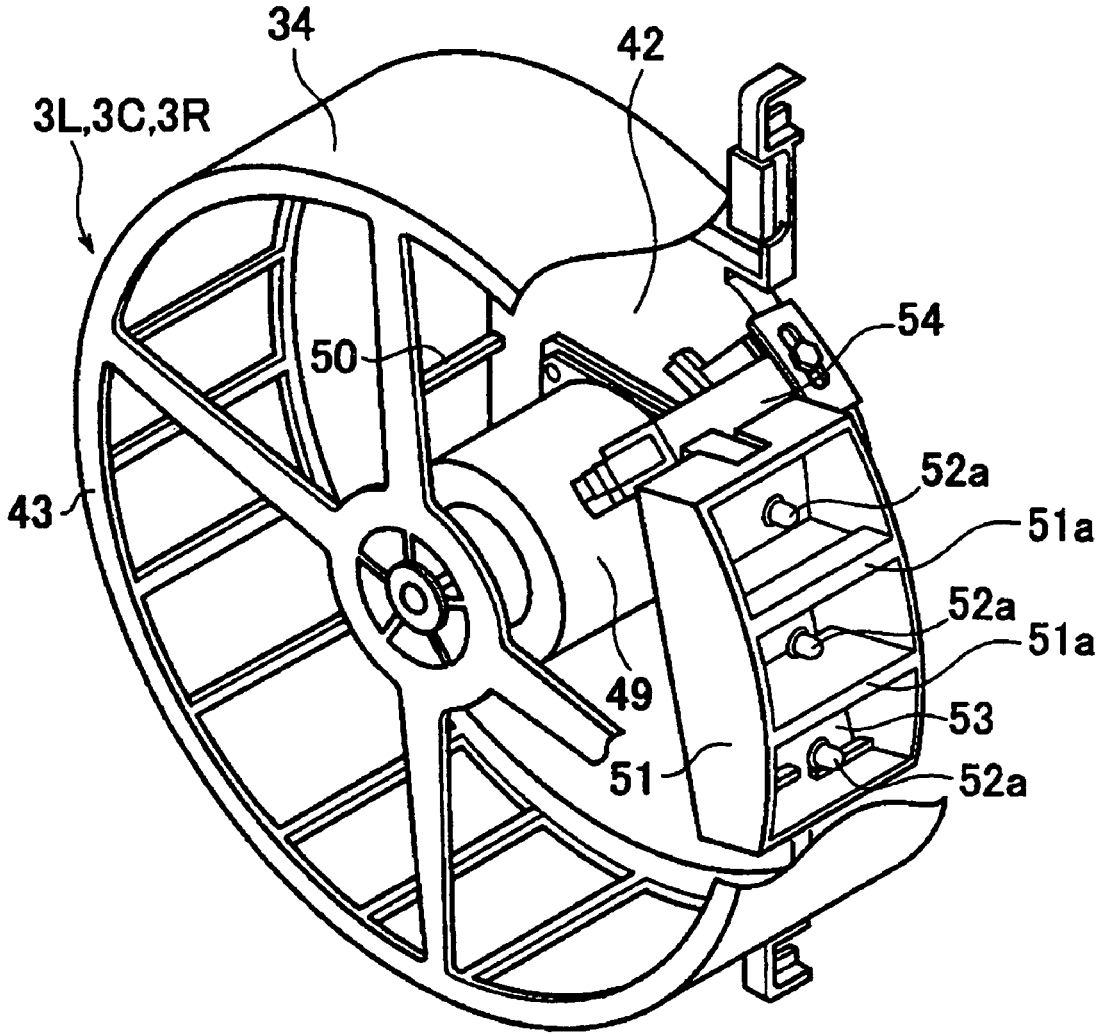
FIG. 3A is a perspective view of the reel a part of which is broken and FIG. 3B is a perspective view of another lamp case.
Figure 3B:
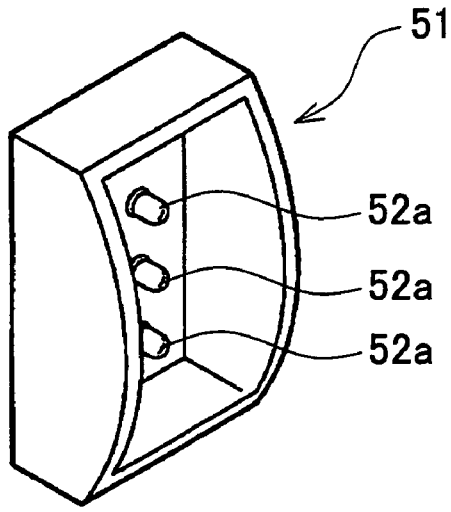

In FIG. 3A, although each of the back lamps 52*a* is independently arranged in each of three parts partitioned by three partition walls 51*a*, the partition walls 51*a* may not be formed as shown in FIG. 3B. By removing the partition walls 51*a*, light emitted from the back lamps 52*a* is not reflected by the partition walls 51*a*, thereby brightness of the back lamps 52*a* can be improved.

Figure 4:
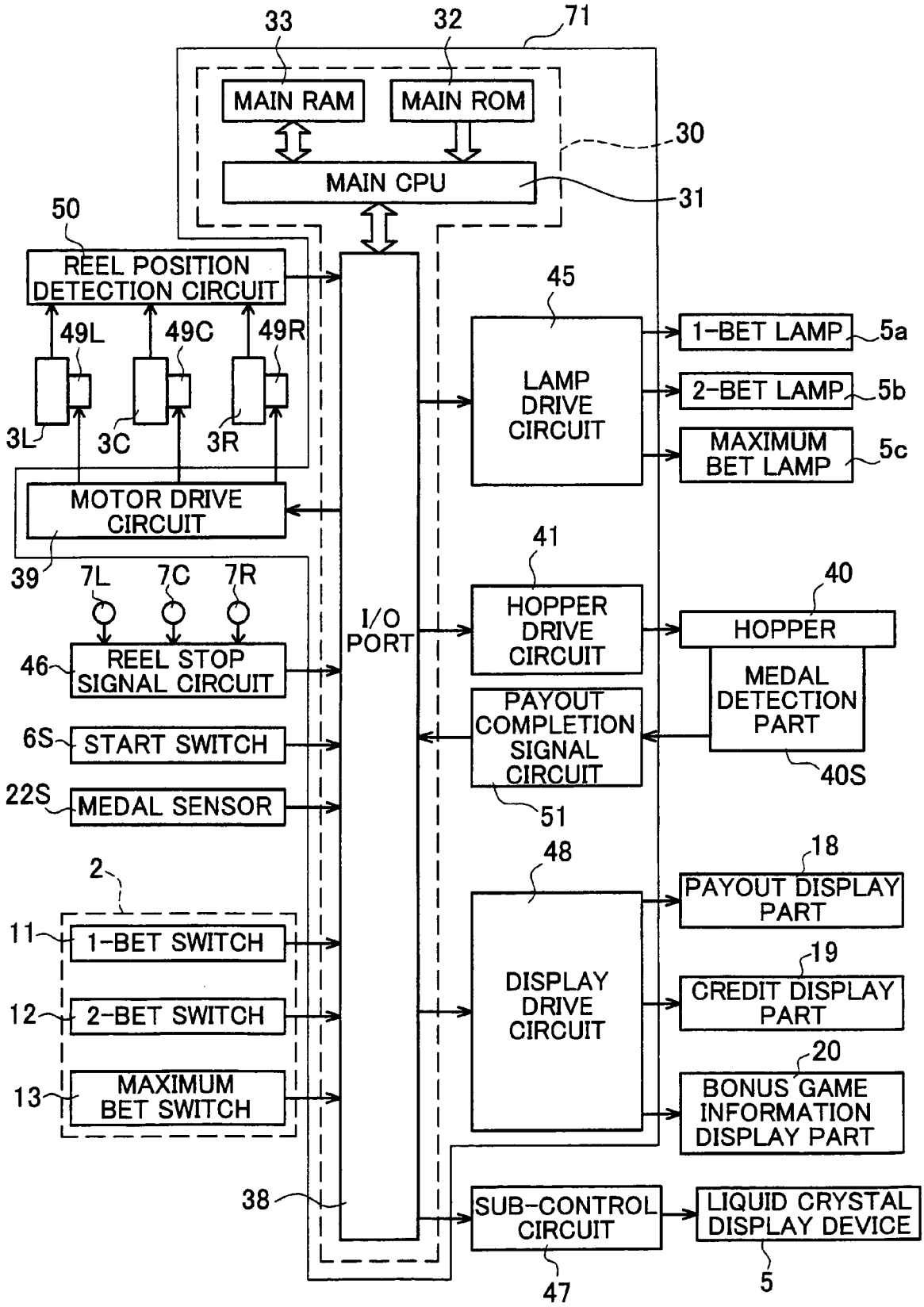
FIG. 4 is a block diagram of the gaming machine in the embodiment.

FIG. 4 is a block diagram indicating an electrical construction of the reel-type gaming machine 1, including the motor stop control device. The motor stop control device is provided with the stepping motor 49, as the drive source of the reel 3 having a plurality of symbols, and drives or stops the stepping motor 49 corresponding to an instruction command (for example, press of the stop buttons 71, 7C, 7R) transmitted from an external.

As shown in FIG. 4, in a microcomputer 71, there are provided a main CPU 31 functioning as a main controller for mainly controlling and calculating, a main ROM 32 for storing programs and various data, a main RAM 33 utilized for data reading and writing, and a random number generator (not shown) for generating predetermined random number values.

Input parts such as a start switch 6S for detecting operation of the start lever 9, a reel stop signal circuit 46 for detecting operation of the stop buttons 7L, 7C, 7R, an input part 2 including BET switches 11~13 for betting credited coins by pressing thereof and output parts such as a motor drive circuit 39, a lamp drive circuit 45, a hopper drive circuit 41 and a display drive circuit 48 are connected to the main CPU 31.

The main CPU 31 functions as the winning combination determination device for determining (conducting the lottery process) a predetermined symbol combination as the winning combination. Concretely, the main CPU 31 determines the predetermined symbol combination (for example, the symbol combination of "BELLS") as the winning combination when operation of the start lever 9 is detected by the start switch 6S.

The main CPU 31 functions as a game value giving device for giving a specific game value to the player in a case that a specific winning mode (for example, the winning combination of "Replay-Replay-Replay" and the like) is stopped and displayed on the reel 3 based on that the determined winning combination is a specific winning combination (for example, the winning combination of "BB", "RB").

And when the stop instruction of the stepping motor 49 occurs based on an instruction from an external, the main CPU 31 is a motor stop control device to conduct any one of a reel stop control process 1 (first process) and a second reel stop control process (second process) according to the kind of the winning combination determined as mentioned above. Here, in reel stop control process 1, the main CPU 31 changes a drive power source A (the power source which is applied to the stepping motor 49 rotating at a constant speed) to a drive power source B2 the voltage value (first voltage value) of which is lower than that of the drive power source A, thus the voltage value applied to the stepping motor 49 is dropped to the first voltage value, and the main CPU 31 conducts stop control of the stepping motor 49 by the 2-phase excitation. And in the reel stop control process 2, the main CPU 31 changes the drive power source A to a drive power source B1 the voltage value (second voltage value) of which lies between the voltage values of the drive power source A and the drive power source B2, thus the voltage value applied to the stepping motor 49 is dropped to the second voltage value, and the main CPU 31 conducts stop control of the stepping motor 49 by the 2-phase excitation.

Concretely, when the stop instruction of the stepping motor 49 occurs based on an instruction from an external, according the kind of the winning combination determined, the main CPU 31 in the embodiment executes any one of the reel stop control process 1 that the main CPU 31 changes the drive power source A to the drive power source B2 the voltage value of which is lower than those of the drive power source A and the drive power source B1 after a predetermined time (for example, the time between turning on of the stop button and t1 as shown in FIG. 6) is elapsed and the main CPU 31 conducts stop control of the stepping motor 49 by the 2-phase excitation, and the reel stop control process 2 that the main CPU 31 changes the drive power source A to the drive power source B1 the voltage value of which is lower than that of the drive power source A and higher than that of the drive power source B2 after a predetermined time (for example, turning on of the stop button and the time t3 shown in FIG. 7B) is elapsed and thereafter a specific time (for example, the time between the time t3 and the time t4 shown in FIG. 7B) is elapsed and the main CPU 31 conducts stop control of the stepping motor 49 by the 2-phase excitation.

Here, FIG. 5 is an explanatory view showing the reel stop control process. As shown in FIG. 5, the reel stop control process includes the drive power source change process to change the drive power source of the stepping motor 49, which is utilized when the reel 3 is stopped, to the other drive power source and the excitation process corresponding the process which is done till the reel 3 is completely stopped from termination of the stop process shown in FIG. 6.

This stop process shown in FIG. 6 means the process which is done till the excitation process is started after any one of the stop buttons 7 is pressed. In the embodiment, the stop process includes the symbol process in which the draw-in process that the main CPU 31 draws the predetermined symbols internally won in the pay line or the slide process that the main CPU 31 slides the predetermined number of symbols so that the predetermined winning combination do not stop along the pay line is done till just before the reel 3 is stopped at the target stop position after the stop buttons 7 are pressed. And in the embodiment the drive power source is selected when the stop process is terminated.

And in the reel stop control process 1, both the process to change the present drive power source A as the drive power source to the drive power source B2 the voltage value of which is lower than that of the drive power source B1 and the 2-phase excitation as the excitation process are executed. On the other hand, in the reel stop control process 2, both the process to change the present drive power source A as the drive power source to the drive power source B1 the voltage value of which is lower than that of the drive power source A and the 2-phase excitation as the excitation process are executed. Here, among the drive power sources there is a relation of the drive power source A>the drive power source B1>the drive power source B2.

FIG. 6 is an explanatory view showing a timing chart of the reel stop control process 1. And FIG. 7 is an explanatory view of a timing chart of the reel stop control process 2. Here, among the times shown in FIGS. 6 and 7 there is an relation of t1 (t1=t3)>t4>t5>t2.

Figures 6A, 6B:
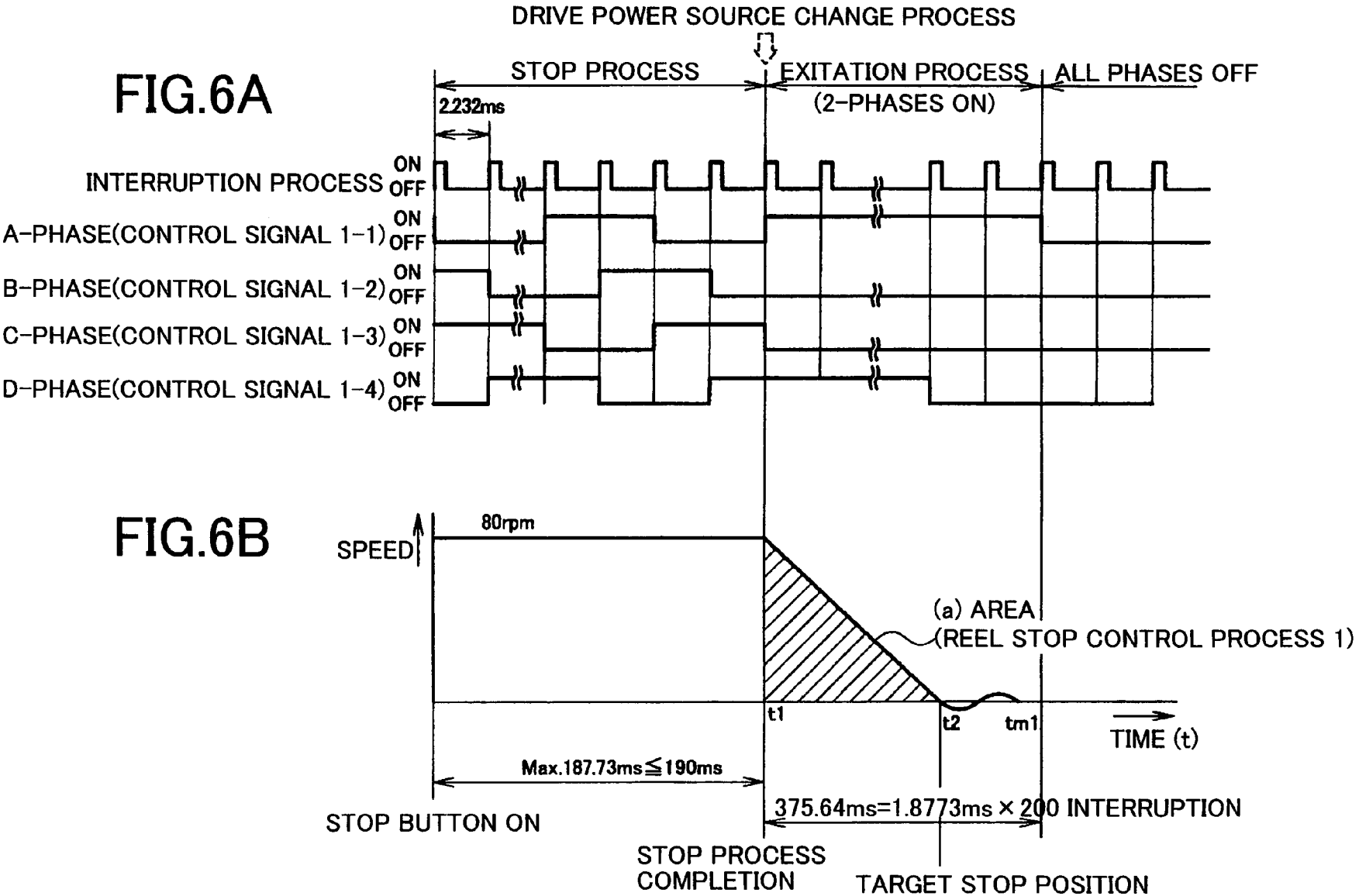
FIG. 6A is an explanatory view indicating pulses in each phase, the pulses being transmitted from a main CPU to a motor drive circuit during a stop process and an excitation process
FIG. 6B is an explanatory view indicating a rotation speed of the reel against time when the motor drive circuit drives the stepping motor.

FIGS. 6A and 7A are explanatory views indicating pulses in each phase, the pulses being transmitted from the main CPU 31 to the motor drive circuit 39 during the stop process and the excitation process. Each of the control signals 1-1 to 1-4 corresponds to a current running to the bases of the transistors TR1 to TR4 in the motor drive circuit 39 mentioned later.

FIGS. 6B and 7B are explanatory views (speed characteristic views) indicating the rotation speed of the reel 3 against time when the motor drive circuit 39 drives the stepping motor 49 based on the pulses in each phase received from the main CPU 31. In the embodiment, the time indicated in FIGS. 6B and 7B corresponds to the time indicated in FIGS. 6A and 7A.

As shown in FIG. 6B, in the reel stop control process 1, when the predetermined time t1 (the time between turning on of the stop button and the time t1) is elapsed since the stop button is pressed (the stop process in the reel stop control process 1 is terminated), the main CPU 31 conducts the process (power source change process) to change the drive power source A (for example, 12V) utilized when the stepping motor 49 is rotated at the constant speed to the drive power source B2 (for example, 5V) the voltage value of which is lower than that of the drive power source B1 (for example, 7V) and the main CPU 31 executes the stop control of the stepping motor 49 by the 2-phase excitation.

On the other hand, as shown in FIG. 7B, in the reel stop control process 2, when the predetermined time t3 (the time between turning on of the stop button and the time t3) is elapsed and thereafter the specific time (the time between the time t3 and the time t4) is also elapsed, the main CPU 31 conducts the process (power source change process) to change the drive power source A (for example, 12V) utilized when the stepping motor 49 is rotated at the constant speed to the drive power source B1 (for example, 7V) the voltage value of which is lower than that of the drive power source A and the main CPU 31 executes the stop control of the stepping motor 49 by the 2-phase excitation.

Here, the speed characteristics shown in FIGS. 6B and 7B are made to have a characteristic so that the stop position of the symbol when the reel stop control process 1 is applied and the stop position of the symbol when the reel stop control process 2 is applied become equal.

Concretely, as shown in FIGS. 6B and 7B, the stop process and the excitation process are executed in both the reel stop control process 1 and the reel stop process 2 so that the area (a)(shown in FIG. 6B by inclined lines) becomes equal to the area (b)(shown in FIG. 7B by inclined lines). Here, the area (a) and the area (b) correspond to the movement distance of the reel. Therefore, if the reel stop control process 1 and the reel stop control process 2 are executed so that the area (a) and the area (b) become equal with each other, the motor stop control device can stop the symbol at the same stop position even if any one of the reel stop control process 1 and the reel stop control process 2 is utilized.

The area (a) in the reel stop control process 1 comprises a triangle in which the base is defined as the difference between the time t1 that the stop process is terminated and the time t2 that the rotation speed of the reel 3 becomes 0 (zero) by the 2-phase excitation, and the height is defined as the rotation speed at the time t1.

The area (b) in the reel stop control process 2 comprises a trapezoid in which the upper base is defined as the difference between the time 3 that the stop process in the reel stop control process 1 is terminated and the time t4 that the stop process in the reel stop control process 2 is terminated, and the lower base is defined as the difference between the time 3 and the time 5 that the rotation speed of the reel 3 becomes 0 (zero) by the 2-phase excitation, and further the height is defined as the rotation speed of the reel 3 at the time t3.

As mentioned, the timings that the stop process, the excitation process and the drive power source change process are executed are preset beforehand so that the area (a) and the area (b) become equal with each other. And the main CPU 31 executes the stop process, the excitation process and the drive power source change process in the reel stop control process 1 or the reel stop control process 2 according to the above timings.

As shown in FIGS. 6B and 7B, comparing the reel stop control process 1 with the reel stop control process 2, inclinations in the reel stop control process 1 and the reel stop control process 2 are different, the rotation speed going down from the constant speed to 0 (zero) according to the inclination. The reason is as follows. In the reel stop control process 1, the drive power source change process is executed faster than that in the reel stop control process 2 and the voltage value of the drive power source B2 changed by the drive power source change process is lower than that of the drive power source B1 changed in the reel stop control process 2, therefore a holding power of the stepping motor 49 in the excitation process becomes small. Thus, in the reel stop control process 1, change in the inclination representing the speed characteristic at the stop of the stepping motor 49 becomes slower in comparison with the inclination of the reel stop control process 2 and the time (the time between the time t1 and the time t2) till the rotation speed of the reel 3 becomes 0 (zero) since the stop process is completed becomes longer in comparison with that in the reel stop control process 2.

And the time (the time between the time t2 and the time tm1) till the reel 3 is completely stopped since the rotation speed of the reel 3 becomes 0 (zero)(this time is abbreviated as "vibration time" hereinafter) becomes shorter in comparison with such time in the reel stop control process 2. That is to say, the vibration time in the reel stop control process 1 becomes shorter than the vibration time in the reel stop control process 2, mentioned later.

On the other hand, in the reel stop control process 2, although the drive power source change process is executed slower than that in the reel stop control process 1, the voltage value of the drive power source B1 changed by the drive source change process is higher than that of the drive power source B2 changed in the reel stop control process 1, therefore a holding power of the stepping motor 49 in the excitation process becomes large. Thus, in the reel stop control process 2, change in the inclination representing the speed characteristic at the stop of the stepping motor 49 becomes steeper in comparison with the inclination of the reel stop control process 1 and the time (the time between the time t4 and the time t5) till the rotation speed of the reel 3 becomes 0 (zero) since the stop process is completed becomes shorter in comparison with that in the reel stop control process 1.

And the time (the time between the time t5 and the time tm2) till the reel 3 is completely stopped since the rotation speed of the reel 3 becomes 0 (zero)(this time is abbreviated as "vibration time" hereinafter) becomes longer in comparison with such time in the reel stop control process 1. That is to say, the vibration time in the reel stop control process 2 becomes longer than the vibration time in the reel stop control process 1.

Further, the amplitude in the vibration time of the reel stop control process 2 is larger than that in the vibration time of the reel stop control process 1. Thus, if the reel stop control process 2 is executed, the reel 3 is stopped while remarkably vibrating in up and down directions at the stop thereof, in comparison with a case that the reel stop control process 1 is executed.

As mentioned, even if any one of the reel stop control process 1 and the reel stop control process 2 is utilized, the stop positions in both the processes become equal and further if the reel stop control process 1 is utilized, the time till the rotation speed of the reel 3 becomes (zero) since the excitation process is started becomes longer. Therefore, the player sees the reel 3 as if the reel 3 is stopped slowly. On the other hand, if the reel stop control process 2 is utilized, the time till the rotation speed of the reel 3 becomes 0 (zero) since the excitation process is started becomes shorter. Therefore, the player sees the reel 3 as if the reel 3 is stopped fast. Thereby, in the gaming machine 1, the stop process of the reel 3 can be changed according to the kind of winning combination. Accordingly, the kind of winning combination can be informed to the player through the stop process of the reel 3 and interest for games can be raised.

And since the vibration time (the time between the time t5 and the time tm2) in the reel stop control process 2 becomes longer than the vibration time (the time between the time t2 and the time tm1) in the reel stop control process 1, vibration mode of the reel 3 can be changed according to the kind of winning combination in the gaming machine 1 and the kind of winning combination can be informed to the player through the vibration mode of the reel 3, thus interest for games can be raised.

Further, since the amplitude in the vibration time of the reel stop control process 2 is larger than the amplitude in the vibration time of the reel stop control process 1, the amplitude of the reel 3 can be changed according to the kind of winning combination in the gaming machine 1 and the vibration mode of the reel 3 can be variegated, thus interest for games can be raised.

The motor drive circuit 39 drives or stops the stepping motor 49 based on commands from the main CPU 31. Here, the stepping motor 49 is 4-phase motor and has four drive coils through A-phase to D-phase. And in the embodiment, each phase is defined so as to stand in order A-phase, B-phase, C-phase and D-phase in anti-clockwise direction. Further, A-phase and C-phase or B-phase and D-phase form one pair and current running in one phase in the one pair of two phases has the reverse phase different from current running in the other phase in the one pair.

The motor drive circuit 39 serially excites the drive coil in each phase based on commands from the main CPU 31, thereby the rotor in the stepping motor 49 is driven to rotate.

Figure 8:
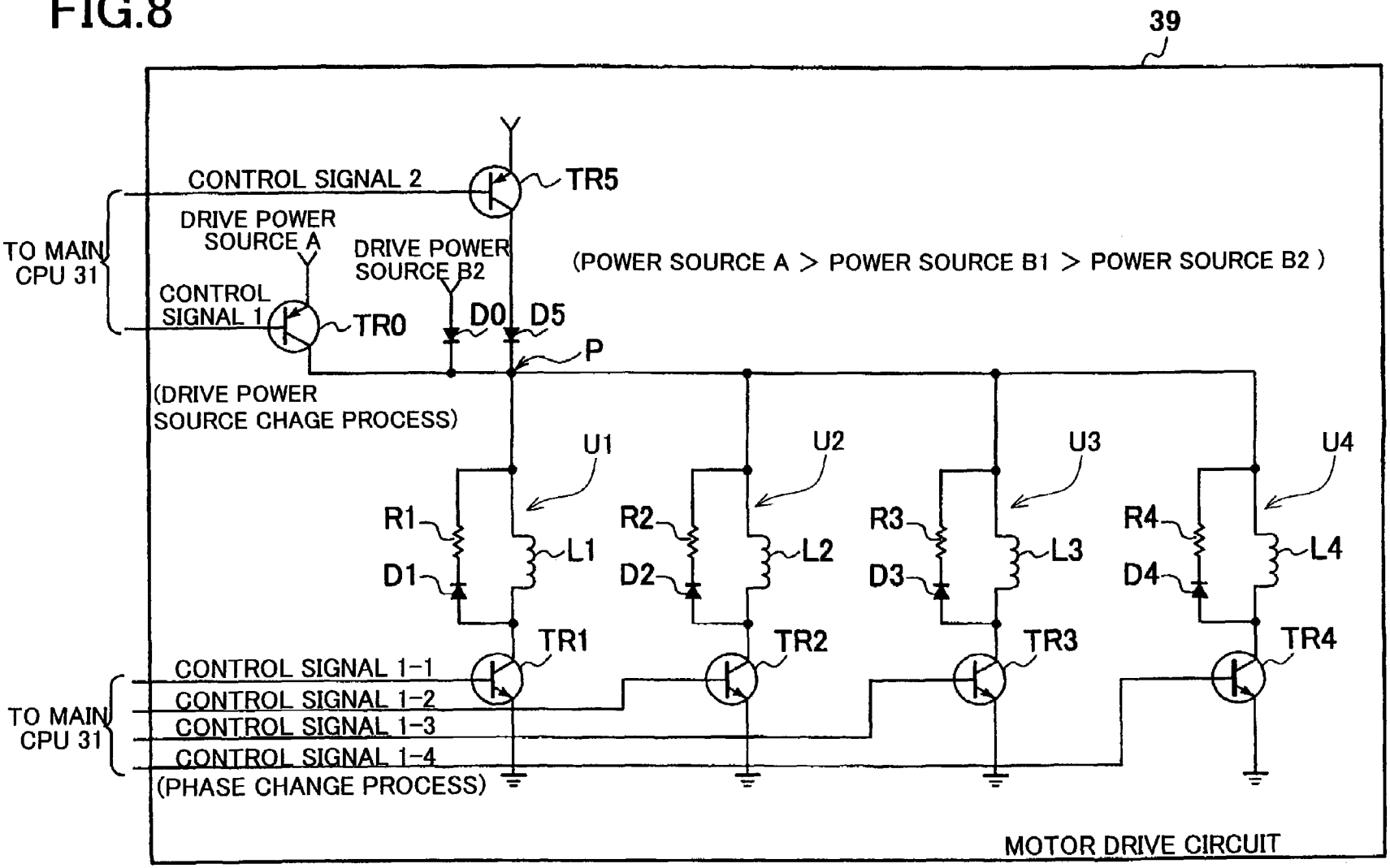
FIG. 8 is a circuit diagram showing an inner construction of the motor drive circuit.

FIG. 8 is a circuit diagram showing an inner construction of the motor drive circuit 39. As shown in FIG. 8, in the motor drive circuit 39, there are provided the drive power source A, the power source B1, the drive power source B2, the diode D0 an anode of which is connected to the drive power source B2 and the transistor TR0 an emitter of which is connected to the drive power source A and a collector of which is connected to a cathode of the diode D0, the transistor TR5 an emitter of which is connected to the drive power source B1 and an collector of which is connected to an anode of the diode D5 and the diode D5 a cathode of which is connected to the collector of the transistor TR0.

(1) As for the drive power source A utilized when the stepping motor 49 is rotated at the constant speed.

In order that the drive power source A is utilized when the stepping motor 49 is rotated at the constant speed, as shown in FIGS. 8 and 9, when the control signal 1 runs to the base of the transistor TR0 (when the transistor TR0 is turned on), the drive power source A is applied to the point P. In this case, since there is the relation of the drive power source A>the drive power source B1>the drive power source B2, the voltage value applied to the point P becomes the drive power source A in spite whether or not the control signal 2 runs to the base of the transistor TR5.

(2) As for the Drive Power Source B2 Utilized in the Reel Stop Control Process 1

In order that the drive power source B2 is utilized in the reel stop control process 1, as shown in FIGS. 8 and 9, when the control signals 1 and 2 does not run to the bases of the transistors TR0 and TR5, respectively, (when the transistors TR0 and TR5 are turned off), the drive power source B2 is applied to the point P. Thereby, the transistors TR0 and TR5 are turned off while the stepping motor 49 is rotated at the constant speed, thus it is realized a state that the drive power source A and the drive power source B1 are not applied and the drive power source is changed from the drive power source A to the drive power source B2 at the point P.

(3) As for the Drive Power Source B1 Utilized in the Reel Stop Control Process 2

In order that the drive power source B1 is utilized in the reel stop control process 2, as shown in FIGS. 8 and 9, when control signal 2 runs to the base of the transistor TR5 (when the transistor TR5 is turned on), the drive power source B1 is applied to the point P. In this case, it is controlled so that the control signal 1 does not run to the base of the transistor TR0 (the transistor Tr0 is turned off), Thereby, the transistor TR0 is turned off, the transistor Tr0 being turned on while the stepping motor 49 is rotated at the constant speed, and the transistor TR5 is turned on, the transistor TR5 being turned off while the stepping motor 49 is rotated at the constant speed. Thus, it is realized a state that the drive power source A is not applied and the voltage value of the drive power source B1 is larger than that of the drive power source B2. Accordingly, the drive power source is changed from the drive power source A to the drive power source B1.

And in the motor drive circuit 39, it is provided a reel stop unit U1 constructed from a resistor R1 one end of which connected to the collector of the transistor TR0, an reactance L1 one end of which is connected to the collector of the transistor TR0, a diode D1 a cathode of which is connected to the other end of the resistor R1 and an anode of which is connected to the other end of the reactance L1 and a transistor TR1 a collector of which is connected to the other end of the reactance L1 and an emitter of which is grounded. And the reel stop units U2 to U4 each of which has the same construction as the reel stop unit U1 are connected parallel to the reel stop unit U1, respectively.

And when the control signals 1-1 to 1-4 respectively run to each of the bases of transistors TR1 to TR4 which are provided in the reel stop units U1 to U4, the phase corresponding to each of the transistors TR1 to TR4 is excited.

The excitation process by the 2-phase excitation is, for example, the process that the main CPU 31 runs the pulses to excite the phase A and the phase B (the control signals 1-1 and 1-2) to the transistors TR1 and TR2 provided in the motor drive circuit 39 after the stop process is terminated. And the transistors TR1 and TR2 excite (the 2-phase excitation), for example, the phase A and phase B only for a predetermined time interval, based on the pulses input thereto. This excitation process is continued for a predetermined time interval, thereby the stepping motor 49 is completely stopped. Here, the excitation phase is changed (phase change process) based on that the main CPU 31 changes the present control signal to the other control signal.

FIG. 10 is an explanatory view showing the selection table utilized when the reel stop control process is selected. In the selection table shown in FIG. 10, the winning combinations and the reel stop control processes are corresponded.

The above main CPU 31 executes any one of the reel stop control 1 and the reel stop control process 2, according to the kind of winning combination determined thereby.

(Reel Stop Control Method by the Motor Drive Control Device)

Figure 11:
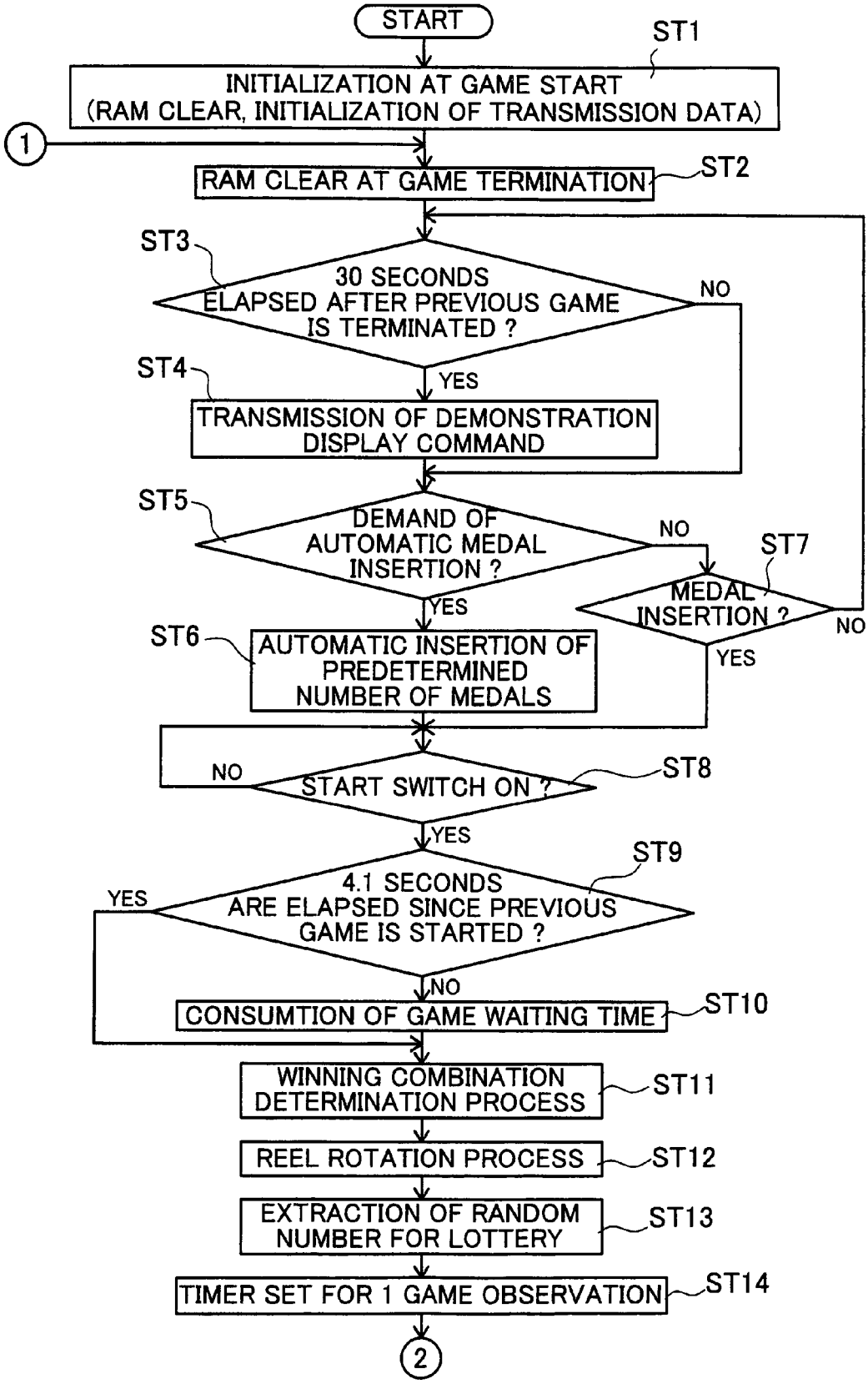
FIG. 11 is a flowchart showing operation of the motor drive control device, in the embodiment.
Figure 12:
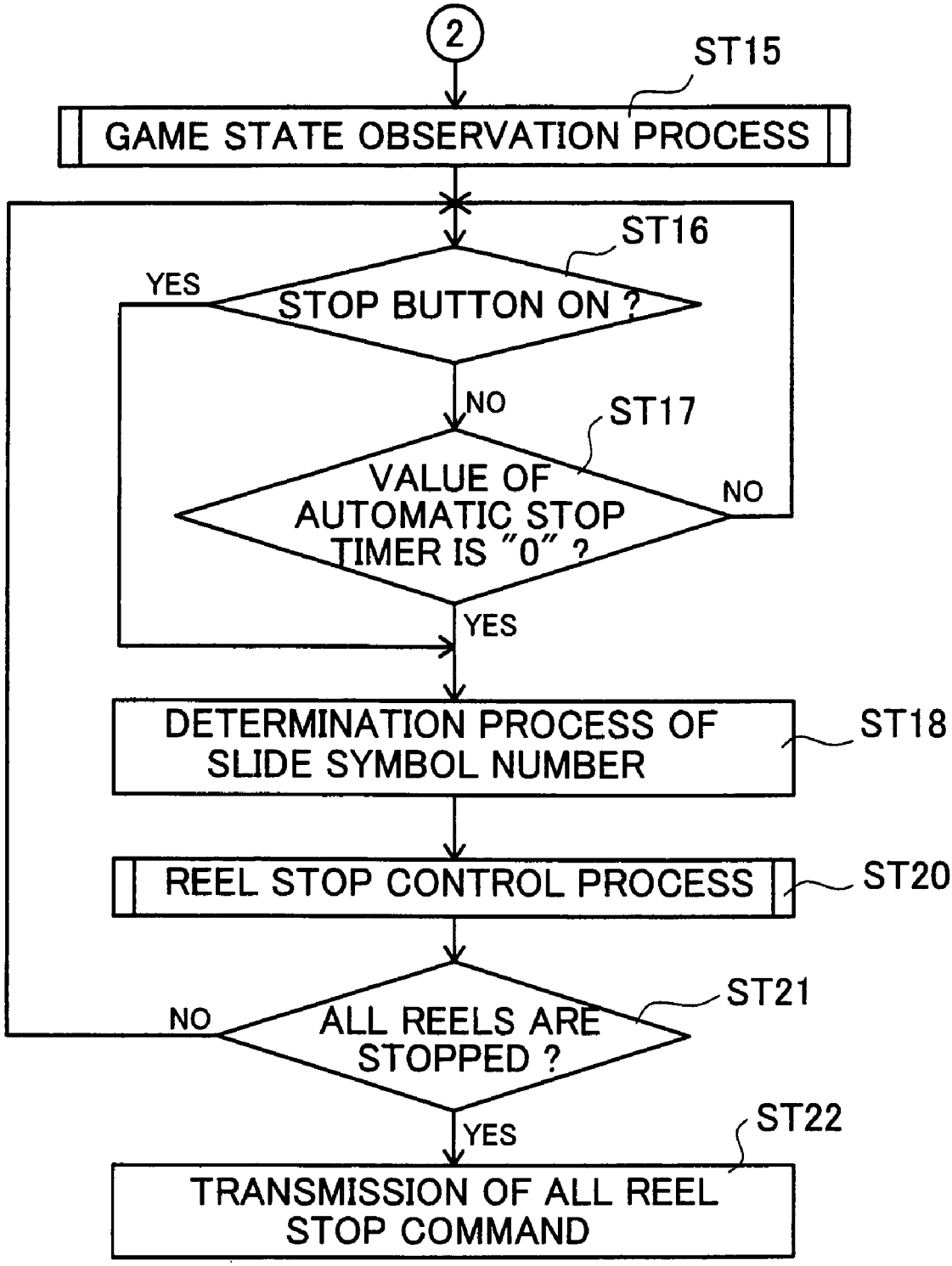
FIG. 12 is a flowchart showing operation of the motor drive control device, the operation being executed continuously to the operation shown in FIG. 11, in the embodiment.
Figure 13:
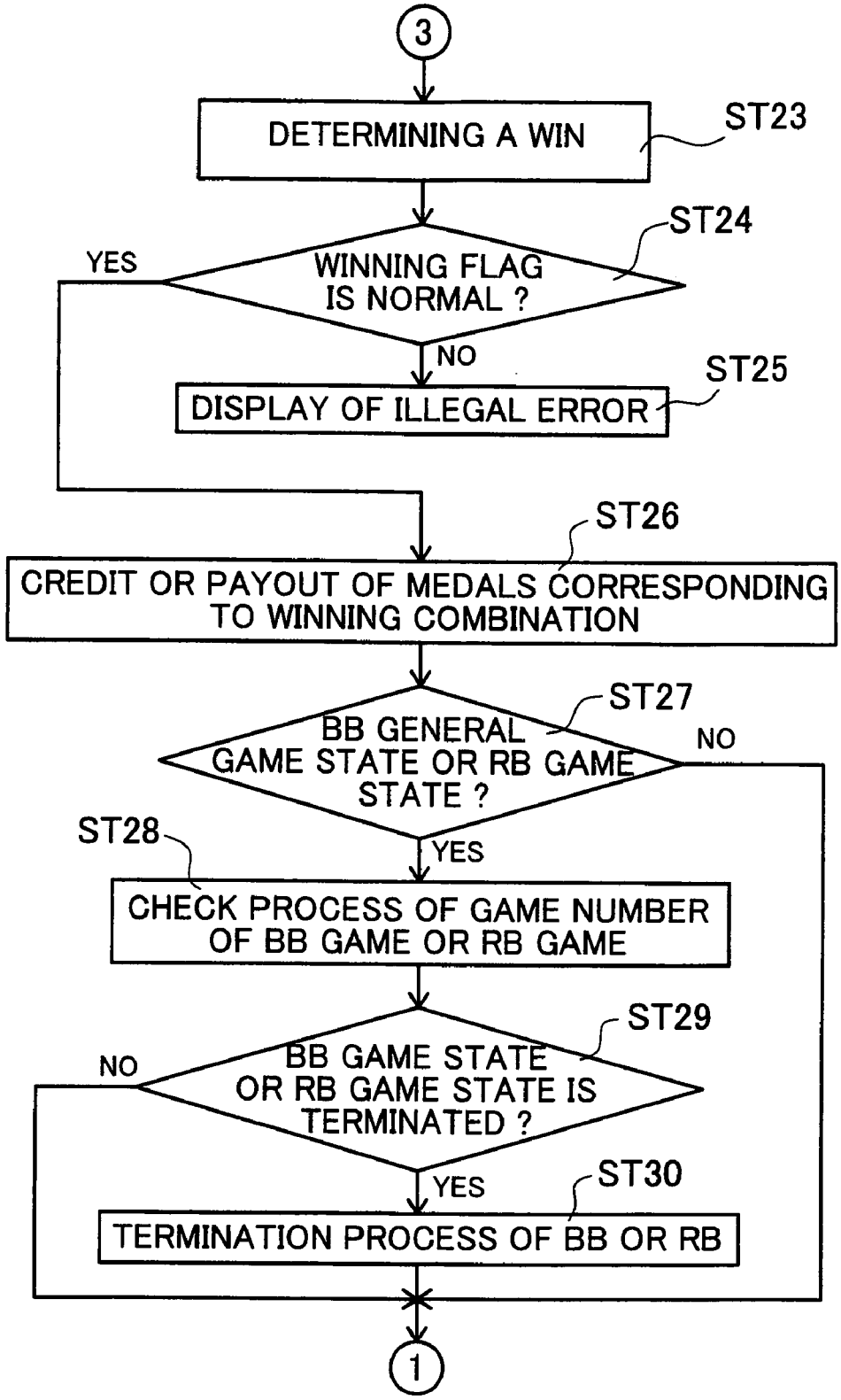
FIG. 13 is a flowchart showing operation of the motor drive control device, the operation being executed continuously to the operation shown in FIG. 12, in the embodiment.

The reel stop control method by the motor drive control device constructed according to the above will be executed by the following procedures. FIGS. 11 to 13 are flowcharts showing operation of the motor drive control device.

As shown in FIG. 11, in step 1 (abbreviated as "ST1" hereinafter), the main CPU 31 initializes predetermined data (data stored in the main RAM 33, transmission data and the like).

In ST2, the main CPU 31 erases the data stored in the main RAM 33 at the time that the previous game is terminated. Concretely, the main CPU 31 erases parameters utilized in the previous game from the main RAM 33 and writes parameters utilized in the next game in the main RAM 33.

In ST3, the main CPU 31 determines whether or not 30 seconds are elapsed since the previous game is terminated (all reels 3L, 3C, 3R are stopped). In a case that 30 seconds are elapsed, the main CPU 31 executes the process in ST4, and on the other hand, if 30 seconds are not elapsed, the main CPU 31 executes the process in ST5.

Here, in ST4, the main CPU 31 transmits "demonstration display command" to display demonstration image to a sub-control circuit 47.

In ST5, the main CPU 31 determines whether or not the "replay", which is one of the winning combinations, is won in the previous game. In a case that the "replay" is won, the main CPU 31 executes the process in ST6, and if the "replay" is not won, the main CPU 31 executes the process in ST7.

Here, in ST6, the main CPU 31 automatically inserts a predetermined number of medals based on that the "replay" is won.

In ST7, the main CPU 31 determines whether or not medals are inserted by the player. Concretely, the main CPU 31 determines whether or not the switch signal is input from the medal sensor 22S or one of the BET switches 2*a* ~2*c*. And in a case that such switch signal is input to the main CPU 31, the main CPU 31 executes the process in ST8. On the other hand, in a case that such switch signal is not input to the main CPU 31, the main CPU 31 executes the process in ST3.

In ST8, the main CPU 31 determines whether or not the star lever 9 is operated by the player. Concretely, the main CPU 31 determines whether or not the switch signal is input from the start switch 6S. And in a case that the switch signal is input from the start switch 6S, the main CPU 31 executes the process in ST9.

In ST9, the main CPU 31 determines whether or not 4.1 seconds are elapsed since the previous game is started. And in a case that 4.1 seconds are elapsed, the main CPU 31 executes the process in ST11, and on the other hand, in a case that 4.1 seconds are not elapsed, the main CPU 31 executes the process in ST10.

In ST10, the main CPU 31 invalidates the input from the start switch 6S till 4.1 seconds are elapsed since the previous game is started.

In ST11, the main CPU 31 determines the predetermined symbol combination as the winning combination based on a lottery result.

In ST12, the main CPU 31 transmits the instruction command to the motor drive circuit 39 so that the reels 3 are rotated.

In ST13, the main CPU 31 extracts the random number which is utilized for various determinations.

In ST14, the main CPU 31 sets a predetermined time to the 1 game observation timer. Here, the 1 game observation timer includes an automatic stop timer to which a predetermined time is set in order to automatically stop the reels 3 without stop operation by the player.

In ST15, the main CPU 31 conducts the game state observation process.

In ST16, the main CPU 31 determines whether or not the stop buttons 7L, 7C, 7R are operated by the player. Concretely, the main CPU 31 determines whether or not the input from the reel stop signal circuit 46 is "on". And if such input from the reel stop signal circuit 46 is "on", the main CPU 31 shifts the procedure to ST 18. On the other hand, if the input from the reel stop signal circuit 46 is "off", the main CPU 31 shifts the procedure to ST17.

In ST17, the main CPU 31 determines whether or not the value of the automatic stop timer is "0". And if such value is "0", the main CPU 31 conducts the process in ST18. On the other hand, if such value is not "0", the main CPU 31 conducts the process in ST17.

In ST18, the main CPU 31 determines the number of slide symbols.

In ST20, the main CPU 31 conducts the process to stop the reels 3. Detailed description thereof will be done hereinafter.

In ST21, the main CPU 31 determines whether or not all reels 3 are stopped. And if all reels 3 are stopped, the main CPU 31 conducts the process in ST21. On the other hand, if all reels 3 are not stopped, the main CPU 31 conducts the process in ST16.

In ST22, the main CPU 31 sets the command indicating that all reels 3 are stopped.

In ST23, the main CPU 31 conducts determination of a win (the winning combination). Here, the determination of the win (the wining combination) means that the winning flag is set in order to distinguish the winning combination based on the stop mode of the symbols along the panel display windows 5L, 5C, 5R. Concretely, the main CPU 31 distinguish the winning combination based on the code numbers of the symbols stopped along the center pay line and the winning combination determination table (not shown).

In ST24, the main CPU 31 determines whether or not the winning flag is normal. And if the winning flag is normal, the main CPU 31 conducts the process in ST26. On the other hand, if the winning flag is not normal, the main CPU 31 conducts the process in ST 25.

In ST25, the main CPU 31 conducts the display of illegal error.

In ST26, the main CPU 31 stores or pays out the medals corresponding to the winning combination.

In ST27, the main CPU 31 determines whether game condition is the "BB general game state" or the "RB game state". And if game condition is the "BB general game state" or the "RB game state", the main CPU 31 conducts the process in ST28. On the other hand, if game condition is not the "BB general game state" or the "RB game state", the main CPU 31 terminates procedure.

In ST28, the main CPU 31 checks the number of the BB game and the number of the RB game number. In this process, for example, the game number of the "BB general game state", the occurrence number of the "RB game state" in the "BB general game state", the game number in the "RB game state" and the winning number of times in the "RB game state" are checked.

In ST29, the main CPU 31 determines whether or not the "BB general game state" or the "RB game state" is terminated. And if games in the "BB general game state" or the "RB game state" are terminated, the main CPU 31 conducts the process in ST30. On the other hand, if games in the "BB general game state" or the "RB game state" are not terminated, the main CPU 31 conducts the process in ST2.

In ST30, the main CPU 31 clears the work area in the main RAM 33, the work area being used in the "BB general game state" or the "RB game state".

Figure 14:
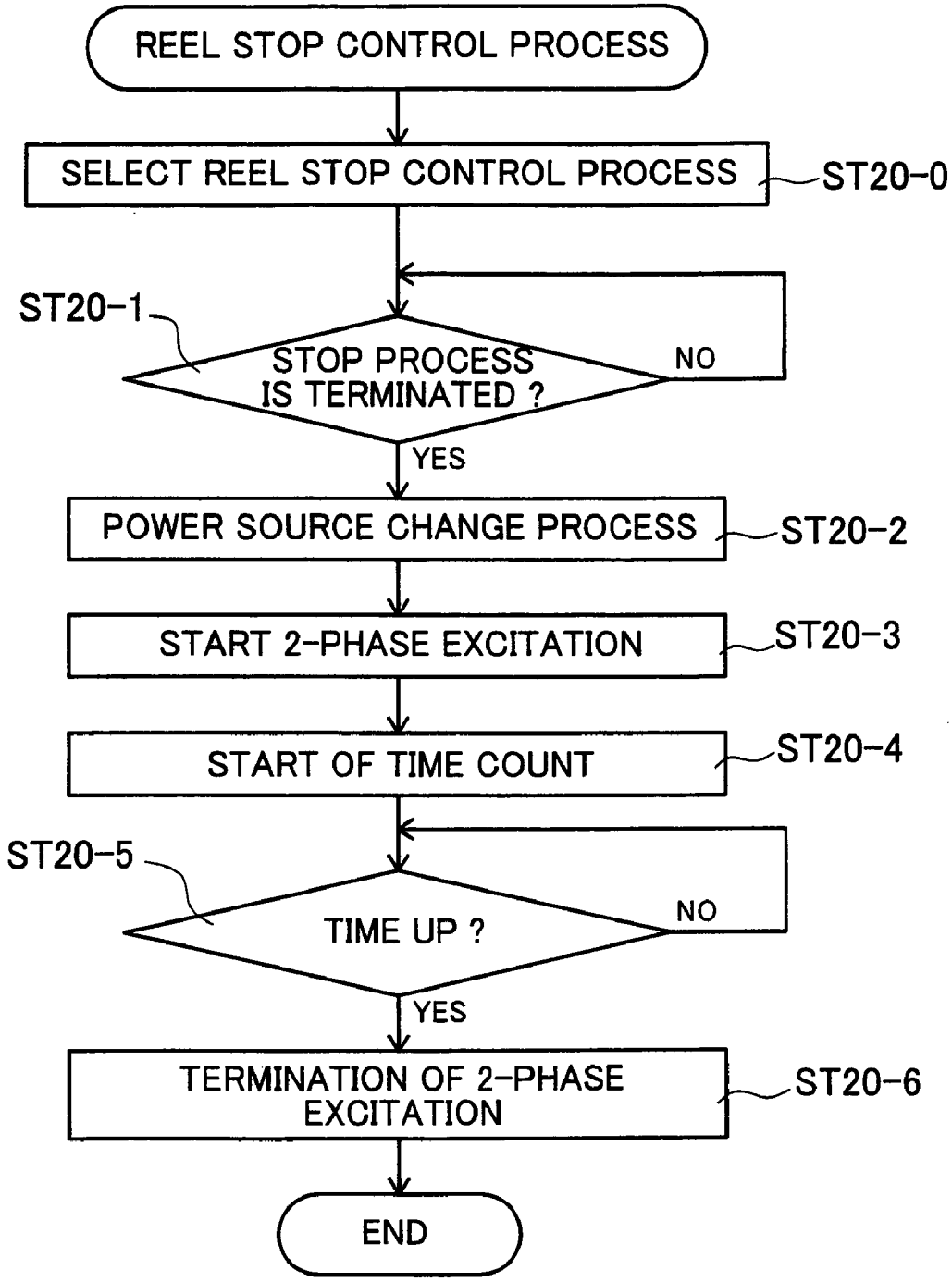
FIG. 14 is a flowchart showing operation of the reel stop control process.

FIG. 14 is a flowchart showing procedures in the reel stop control process in ST20.

As shown in FIG. 14, in the ST20-0, the main CPU 31 selects any one of the reel stop control processes according to the kind of winning combination determined in ST11. Concretely, for example, the main CPU 31 refers the selection table shown in FIG. 9 and selects the reel stop control process 1 if the determined winning combination is the "water melon", and the main CPU 31 selects the reel stop control process 2 if the determined winning combination is the "RB" or "BB".

As shown in FIG. 14, in ST20-1, the main CPU 31 determines whether or not the stop process is terminated. And when the main CPU 31 determines that the stop process is not terminated, the main CPU 31 again conducts the process in ST20-1. And when the main CPU 31 determines that the stop process is terminated, procedure shifts to ST20-2.

In the ST20-2, if the reel stop control process selected in ST20-0 is the reel stop control process 1, the main CPU 31 terminates the stop process shown in FIG. 6 and thereafter changes the drive power source A applied to the stepping motor 49 rotating at the constant speed to the drive power source B2.

On the other hand, if the reel stop control process selected in ST20-0 is the reel stop control process 2, the main CPU 31 terminates the stop process shown in FIG. 67 and thereafter changes the drive power source A applied to the stepping motor rotating at the constant speed to the drive power source B1.

In ST20-3, the main CPU 31 starts the excitation process by the 2-phase excitation.

In ST20-4, the main CPU 31 counts the time during which the excitation process by the 2-phase excitation is executed.

In ST20-5, the main CPU 31 determines whether or not the time counted in ST20-4 exceeds a predetermined time. When the main CPU 31 determines that the counted time does not exceed the predetermined time, the main CPU 31 repeats this process in ST20-5. And when the main CPU 31 determines that the counted time exceeds the predetermined time, procedure shifts to ST20-6.

In ST20-6, the main CPU 31 terminates the excitation process by the 2-phase excitation.

(Operation and Effect by the Motor Stop Control Device)

According to the motor stop control device of the embodiment, the main CPU 31 executes any one of the reel stop control process 1 and the reel stop control process 2 corresponding to the kind of winning combination, thereby the motor stop control device can variegate the stop mode of the reel 3 (including the above mentioned stop process of the reel 3 and the vibration mode of the reel 3), thus interest for games can be raised. And since the stop mode of the reel 3 is changed according to the kind of winning combination, the motor stop control device changes the stop process of the reel 3 and inform the kind of winning combination to the player.

Here, although the drive shaft of the stepping motor 49 according to the embodiment is directly pressed into the center hole of the reel 3 (direct drive manner), the present invention is not limited to this. For example, the motor stop control device may be constructed so that the output gear fixed on the drive shaft of the stepping motor 49 meshes with the input gear contacted to the output gear and arranged in the reel 3 so as to be coaxial with the support shaft of the reel 3.

Here, in the gaming machine 1, the phase excited when the stepping motor 49 is rotated at the constant speed or rotation speed of the stepping motor 49 is reduced may be excited by the 2-phase excitation, the 1-2 phase excitation and the like. The excitation manner is not limited.

And the gaming machine 1 may be constructed so that the voltage value and the applying time of the drive power source A, the drive power source B1 and the drive power source B2 are voluntarily changed.

Here, the drive power source is not limited to three kinds of the drive power source A, the drive power source B1 and the drive power source B2. More than three drive power sources may be utilized.

Here, in the embodiment, although the reel stop control process 1 is selected when the predetermined combination (for example, the "replay", the "water melon" and the like) is determined as the winning combination, such reel stop control process 1 may be selected when the specific combination (for example, the "RB" or the "BB" and the like) is determined as the winning combination. On the other hand, although the reel stop control process 2 is selected when the specific combination (for example, the "RB" or the "BB") is determined as the winning combination, the reel stop control process 2 may be selected when the predetermined combination (for example, the "replay", the "water melon") other than the specific combination is determined as the winning combination.

Here, the present invention is not limited to the above embodiment and various modifications may be done within the scope of the present invention. For example, in the above embodiment, although the stop control of the reels 3L, 3C, 3R (the stop control of the stepping motor 49) is conducted based on the signal output from the reel stop signal circuit 46 when any one of the stop buttons 7L, 7C, 7R is pressed, the present invention is not limited. As the trigger to conduct the above stop control, various controls such as stop control signal output from the CPU 31 or the like may also stop the reels 3L, 3C, 3R.

What is claimed is:

1. A motor stop control device utilizable for a gaming machine with a reel on which a plurality of symbols are formed, the motor stop control device comprising:

a winning combination determination device for determining a winning combinations;

a motor having at least three excitation phases to rotate the reel, wherein the motor is a stepping motor; and a motor stop controller for stopping the motor based on a stop instruction;

wherein the motor stop controller executes any one of a first process and a second process corresponding to the winning combination determined by the winning combination determination device when the stop instruction occurs, in the first process the motor stop controller decreasing a predetermined voltage value applied to the motor rotating at a constant speed to a first voltage value lower than the predetermined voltage value and executing a stop control of the motor by 2-phase excitation and in the second process the motor stop controller decreasing the predetermined voltage value to a second voltage value which lies between the predetermined voltage value and the first voltage value and executing the stop control by the 2-phase excitation, wherein the first process includes a stop process for stopping a first predetermined symbol of the reel on a pay line, the first process being executed until a first predetermined time is elapsed since the stop instruction occurs, a power source change process for changing a predetermined power source with the predetermined voltage value to a first power source with the first voltage value, the power source change process being executed right after the first predetermined time is elapsed, and an excitation process for conducting the 2-phase excitation of the stepping motor, the excitation process being executed until the reel is completely stopped, wherein the second process includes a stop process for stopping a second predetermined symbol of the reel on a pay line, the stop process being executed until a second predetermined time including the first predetermined time and a specific time is elapsed since the stop instruction occurs, a power source change process for changing the predetermined power source with the predetermined voltage to a second power source with the second voltage value, the power source change process being executed right after the specific time is elapsed, and an excitation process for conducting the 2-phase excitation of the stepping motor, the excitation process being executed until the reel is completely stopped, and wherein an elapsed time, from when the stop instruction occurs to when the excitation process is completed, in the first process is equal to an elapsed time, from when the stop instruction occurs to when the excitation process is completed, in the second process.

2. The motor stop control device according to claim 1, wherein the motor is a stepping motor with four excitation phases.

3. A gaming machine comprising:

a reel on which a plurality of symbols are formed;

a motor stop control device having a motor with a plurality of excitation phases to rotate the reel and a motor stop controller for stopping the motor based on a stop instruction;

a winning combination determination device for determining a winning combination;

wherein the motor stop controller executes any one of a first process and a second process corresponding to the winning combination determined by the winning combination determination device when the stop instruction occurs, in the first process the motor stop controller decreasing a predetermined voltage value applied to the motor rotating at a constant speed to a first voltage value lower than the predetermined voltage value and executing a stop control of the motor by 2-phase excitation and in the second process the motor stop controller decreasing the predetermined voltage value to a second voltage value which lies between the predetermined voltage value and the first voltage value and executing the stop control by the 2-phase excitation, wherein the first process includes a stop process for stopping a first predetermined symbol of the reel on a pay line, a power source change process for changing a predetermined power source with the predetermined voltage value to a first power source with the first voltage value, and an excitation process for conducting the 2-phase excitation of the stepping motor, wherein the second process includes a stop process for stopping a second predetermined symbol of the reel on a pay line, a power source change process for changing the predetermined power source with the predetermined voltage to a second power source with the second voltage value, and an excitation process for conducting the 2-phase excitation of the stepping motor, wherein a first elapsed predetermined time, from when the stop instruction occurs to when the power source change process is executed, in the first process is shorter than a second elapsed predetermined time, from when the stop instruction occurs to when the power source change process is executed, in the second process, and wherein an elapsed time, from when the stop instruction occurs to when the excitation process is completed, in the first process is equal to an elapsed time from when the stop instruction occurs to when the excitation process is completed, in the second process.

4. A slot machine comprising:

stepping motors as drive sources of a plurality of reels on each of which a plurality of symbols are displayed, the stepping motor being provided corresponding to each of the plurality of reels; and a motor stop controller arranging the symbols on the plurality of reels corresponding to a winning combination determined beforehand, if a symbol combination to be displayed is determined as the winning combination beforehand, wherein if the symbol combination to be displayed is determined as the winning combination beforehand, the motor stop controller executes stop control after stepping down to a first voltage value that is lower than a voltage value already inputted in a first process or to a second voltage value that is lower than the first voltage value in a second process in response to input of motor stop command so as to apply to the stepping motor, wherein the first process includes a stop process for stopping first predetermined symbols of the reels on a pay line, a power source change process for changing a predetermined power source with the predetermined voltage value already inputted to a first power source with the first voltage value, and an excitation process for conducting a 2-phase excitation of the stepping motor, wherein the second process includes a stop process for stopping second predetermined symbols of the reel on a pay line, a power source change process for changing the predetermined power source with the predetermined voltage already inputted to a second power source with the second voltage value, and an excitation process for conducting the 2-phase excitation of the stepping motor, wherein a first elapsed predetermined time, from the input of motor stop command occurs to when the power source change process is executed, in the first process is shorter than a second elapsed predetermined time, from when the input of motor stop command occurs to when the power source change process is executed, in the second process, and wherein an elapsed time, from when the input of motor stop command occurs to when the excitation process is completed, in the first process is equal to an elapsed time, from when the input of motor stop command occurs to when the excitation process is completed, in the second process.

* * * * *